US010344660B1

(12) United States Patent
Harris et al.

(10) Patent No.: US 10,344,660 B1
(45) Date of Patent: Jul. 9, 2019

(54) AERODYNAMICALLY CONFORMAL MUFFLER

(71) Applicant: Northwest ULD, Inc., McMinnville, OR (US)

(72) Inventors: Chris B. Harris, Amity, OR (US); Gregory J. Stadeli, Silverton, OR (US)

(73) Assignee: NORTHWEST ULD, INC., McMinnville, OR (US)

( * ) Notice: Subject to any disclaimer, the term of this patent is extended or adjusted under 35 U.S.C. 154(b) by 161 days.

(21) Appl. No.: 15/584,556

(22) Filed: May 2, 2017

Related U.S. Application Data

(60) Provisional application No. 62/330,792, filed on May 2, 2016.

(51) Int. Cl.
*F01N 13/00* (2010.01)
*F01N 1/08* (2006.01)

(52) U.S. Cl.
CPC ..... *F01N 13/002* (2013.01); *F01N 1/083* (2013.01); *F01N 2590/00* (2013.01)

(58) Field of Classification Search
CPC ..... F01N 1/084; F01N 1/12; F01N 13/002; F01N 13/06; F01N 2590/00; F02B 75/222
See application file for complete search history.

(56) References Cited

U.S. PATENT DOCUMENTS 1,718,201 A * 6/1929 Brockway ..... F01N 1/18 123/44 C
3,009,531 A 11/1961 Mead
3,066,755 A 12/1962 Diehl
3,068,079 A 12/1962 Purse et al.
3,672,773 A 6/1972 Moller
3,692,142 A 9/1972 Stemp
3,744,589 A 7/1973 Mellin
3,927,731 A 12/1975 Lancaster
4,579,195 A 4/1986 Nieri
4,867,270 A 9/1989 Wissmann et al.
5,612,006 A 3/1997 Fisk
6,684,633 B2 2/2004 Jett
6,789,644 B2 9/2004 Mukaida
6,959,782 B2 11/2005 Brower et al.
(Continued)

FOREIGN PATENT DOCUMENTS

FR 840646 A * 4/1939 ..... F01N 13/06

OTHER PUBLICATIONS

Machine translation of FR 840646 A, accessed Jan. 2, 2019.*

*Primary Examiner* — Jonathan R Matthias
(74) *Attorney, Agent, or Firm* — Marsh Fischmann & Breyfogle LLP

(57) ABSTRACT

A muffler for an engine assembly is disclosed. This muffler is arcuately-shaped and may be configured so as to not protrude beyond an outermost perimeter of an engine assembly that uses this muffler. The muffler may include a lower chamber, an intermediate chamber, and an upper chamber that are disposed in a common stack. Exhaust inlet and outlet ports to the muffler may be located at a common end of the muffler body. The exhaust inlet port may lead into the lower chamber. Multiple exhaust outlet ports out of the upper chamber may be utilized to allow the muffler to be used with different vehicle configurations, for instance to direct exhaust out of the muffler in different directions.

37 Claims, 11 Drawing Sheets

(56) References Cited

U.S. PATENT DOCUMENTS

| | | | |
|---|---|---|---|
| 7,472,774 | B1 | 1/2009 | Monson et al. |
| 7,530,428 | B2 | 5/2009 | Feist et al. |
| 7,712,578 | B2 | 5/2010 | Han |
| 7,721,845 | B2 | 5/2010 | Gorenflo |
| 3,006,801 | A1 | 8/2011 | Christoffers et al. |
| 8,602,159 | B2 | 12/2013 | Harris et al. |
| 2005/0023078 | A1 | 2/2005 | Brower et al. |
| 2011/0180347 | A1 | 7/2011 | Butler |

* cited by examiner

AERODYNAMICALLY CONFORMAL MUFFLER

CROSS-REFERENCE TO RELATED APPLICATIONS

This patent application claims the benefit of U.S. Provisional Patent Application No. 62/330,792, that was filed on May 2, 2016, and the entire disclosure of which is hereby incorporated by reference herein.

FIELD OF THE INVENTION

This invention generally relates to mufflers designed for small engines and more specifically small engines as used in the propulsion of unmanned aerial vehicles, radio-controlled model aircraft, watercraft, and powered hand tools.

BACKGROUND

Over the past several decades, muffler designs aiming at compactness and light weight have been introduced in order to accommodate the demands of modern vehicle designs. Being primarily directed to use with four-stroke engines in automobiles and motorcycles, prior art muffler designs have been focused on reducing the size of the muffler system and for enhancing engine efficiency by maintaining low back pressure while adequately reducing exhaust noise by different means. In these designs, the exhaust pipe is partially or wholly enclosed within the body of the muffler to accommodate a duct shaped in a "jellyroll" or spiral passageway enclosed in an outer shell comprising the muffler housing. The spiral passageway is of reduced cross section relative to the header pipe in which exhaust gases increase in velocity and reduced pressure in a gradual manner, thereby greatly reducing the noise associated with the expansion of these gases, while maintaining low pressure and forward flow within the muffler so as greatly lower the backpressure on the engine.

More recently, streamlining muffler systems for two-stroke engines has been addressed. For a two-stroke engine, backpressure is an issue, but in the opposite sense in relation to four-stroke engines, and efforts have been made to design an exhaust system to maintain a certain level of backpressure so that the air/fuel mixture does not empty too quickly from the cylinder on the down-stroke of the piston. The quintessential exhaust processing system for a two-stroke engine has been the tuned straight pipe, adding to the passive backpressure control of the air/fuel charge in the cylinder by sending positive pressure pulses to the cylinder synchronized with the down-stroke to push fresh un-combusted air/fuel charge that had escaped into the exhaust system back into the cylinder just before the compression/combustion stroke of the piston. While the straight tuned pipe works well to enhance two-stroke engine efficiency, and reduce exhaust system noise, in the case of small vehicles and hand tools powered by small two-stroke engines, tuned pipes are in many instances longer and bulkier than the very vehicle or devices on which they are mounted, adding significant weight as well.

SUMMARY

The present invention provides a conventional single pipe exhaust system designed to enhance engine performance and provide noise attenuation packaged into a unique form factor which is integrated into the engine design, and provides enhanced aerodynamic properties without the use of additive engine shrouding.

A first aspect of the present invention is directed to a muffler assembly. This muffler assembly includes a muffler body that may be characterized as having first and second end portions. The muffler body proceeds about a first reference axis proceeding from the first end portion to the second end portion. A first flow path is located within the interior of the muffler body and also proceeds about the first reference axis. An exhaust inlet port to the muffler body is in fluid communication with this first flowpath. There is also a first exhaust outlet port from the muffler body that is also in fluid communication with the first flowpath. The muffler assembly further includes what may be characterized as an engine assembly receptacle that is in the form of an open space. This open space is disposed inwardly of the muffler body in relation to the noted first reference axis such that the muffler body may be characterized as wrapping around at least a portion of an engine assembly in an installed configuration for the muffler assembly (e.g., when the muffler assembly is incorporated by an engine assembly, and where the engine assembly would be disposed within the noted engine assembly receptacle).

A second aspect of the present invention is directed to a muffler assembly that includes a muffler body. There is an exhaust inlet port to an interior of this muffler body, a first exhaust outlet port from the interior of this muffler body, and a second exhaust outlet port from the interior of this muffler body. The first exhaust outlet port and the second exhaust outlet port are oriented to discharge an exhaust flow from the interior of the muffler body in different directions.

A third aspect of the present invention is directed to an engine assembly that includes a propeller, an internal combustion engine, and a muffler assembly. The muffler assembly is arcuately-shaped proceeding about a first reference axis, and this first reference axis is co-linear with or parallel to a rotational axis of the propeller.

A number of feature refinements and additional features are separately applicable to each of above-noted first, second, and third aspects of the present invention. These feature refinements and additional features may be used individually or in any combination in relation to each of the first, second, and third aspects. Initially, the muffler assembly in accordance with each of the first and second aspects may be utilized by the third aspect.

The muffler body may be characterized as being arcuately-shaped proceeding between its first and second end portions and about the noted first reference axis. One embodiment has the first and second end portions of the muffler body being spaced more than 180° apart proceeding about the first reference axis (e.g., the muffler proceeds more than 180° about the first reference axis).

The muffler body includes a first flowpath within the interior of the muffler body. The first flowpath may be characterized as proceeding more than 180° about the first reference axis in flowing from the exhaust inlet port toward an opposite end of the muffler body. The first flowpath may be characterized as including first and second portions. One embodiment has the first portion of the first flowpath extending more than 180° proceeding about the first reference axis in a first direction, while the second portion of the first flowpath extends more than 180° proceeding about the same first reference axis in a second direction that is directly opposite of the first direction. Another embodiment has this first portion of the first flowpath proceeding from the first end portion of the muffler body to the second end portion of the muffler body, while the second portion of the first flowpath proceeds from the second end portion of the muffler body back to the first end portion of the muffler body.

The exhaust inlet port and the first exhaust outlet port may be incorporated at the first end portion of the muffler body. The muffler body may further include a second exhaust outlet port. Such a second exhaust outlet port may also be incorporated at the first end portion of the muffler body. The first and second exhaust outlet ports may be incorporated by the muffler body so as to discharge an exhaust flow out of the body in different directions, for instance in directions that are orthogonal to one another. The first exhaust outlet port may be utilized for a first aircraft configuration (e.g., a pull-type configuration), while the second exhaust outlet port may be used for a second aircraft configuration (e.g., a push-type configuration). A plug may be disposed in one of the first or second exhaust outlet ports, for instance depending upon the application (e.g., aircraft configuration) in which the muffler assembly is being used. That is, the muffler assembly will typically be configured such that only one of the first exhaust outlet port and the second exhaust outlet port will be in use for a given application.

The muffler body may include first, second, and third chambers. The exhaust inlet port may direct a flow of exhaust into the first chamber, while an exhaust flow may be directed out of the third chamber (more generally out of the muffler body) through the first exhaust outlet port. A packing material (e.g., a sound-dampening material) of any appropriate type may be included in the second chamber. There is a first partition between the first chamber and the second chamber, with this first partition including at least one first flow port. There is a second partition between the second chamber and the third chamber, with this second partition including at least one second flow port. Each of the first chamber, second chamber and third chamber extend from the first end portion of the muffler body to the second end portion of the muffler body and proceed about the first reference axis.

The second chamber is located between the first chamber and the third chamber in a dimension corresponding with the direction in which the first reference axis extends. The first chamber, second chamber, and third chamber may be characterized as being stacked in a dimension that corresponds with the dimension in which the first reference axis extends, with the second chamber being located between the first chamber and the third chamber within this stack. The first and third chambers are connected to each other. This path represents the primary, low frequency pressure, high volumetric flow rate path. The first chamber may be characterized as being a lower chamber, the third chamber may be characterized as being an upper chamber, and the second chamber may be characterized as being an intermediate chamber.

The exhaust gas pressure wave flowing into the first chamber through the exhaust inlet port is directed into the second chamber through an array of one or more first flow ports in the first partition between the first chamber and the second chamber. The exhaust gas pressure wave within the second chamber flows into the third chamber through an array of one or more second flow ports in the second partition between the second chamber and the third chamber. Exhaust gases exit the muffler body through the third chamber and the first exhaust outlet port. There may be a plurality of first ports that fluidly connect the first chamber with the second chamber, and there may be a plurality of second ports that fluidly connect the second chamber with the third chamber. One embodiment has the total cross-sectional area of the first ports (between the first chamber and the second chamber) being less than the total cross-sectional area of the second ports (between the second chamber and the third chamber), where a cross-sectional area is taken perpendicular to a flow through a given port.

The muffler assembly may be used by an appropriate engine assembly, such as an engine assembly that uses an internal combustion engine. A vehicle of any appropriate type may utilize such an engine assembly and the muffler assembly. In one embodiment, the engine assembly utilizes a propeller having a rotational axis. The muffler assembly may be incorporated such that the first reference axis is either co-linear with or parallel to this rotational axis. The muffler assembly may be incorporated such that it does not protrude beyond an outermost perimeter of the engine assembly.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular. Moreover, any failure to use phrases such as "at least one" also does not limit the corresponding feature to the singular. Use of the phrase "at least generally" or the like in relation to a particular feature encompasses the corresponding characteristic and insubstantial variations thereof. Finally, a reference of a feature in conjunction with the phrase "in one embodiment" does not limit the use of the feature to a single embodiment.

DETAILED DESCRIPTION

Figure 1:
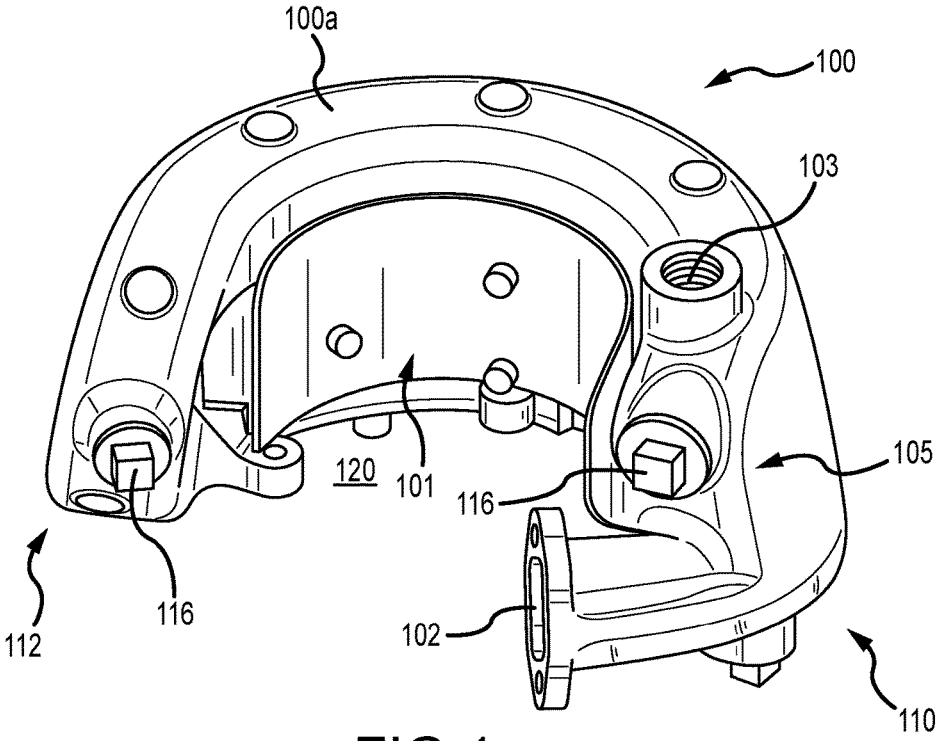
FIG. 1 is a perspective view of one embodiment of a muffler assembly.
Figure 2:
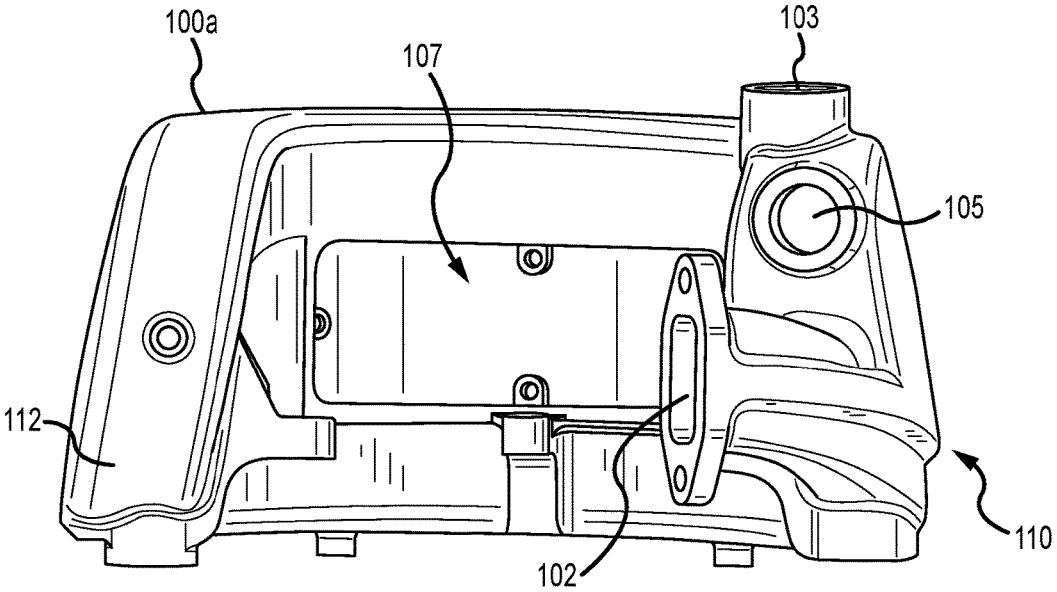
FIG. 2 is a view of the engine side or interior view of the muffler assembly of FIG. 1, with the heat shield and packing door having been removed for clarity.
Figure 3:
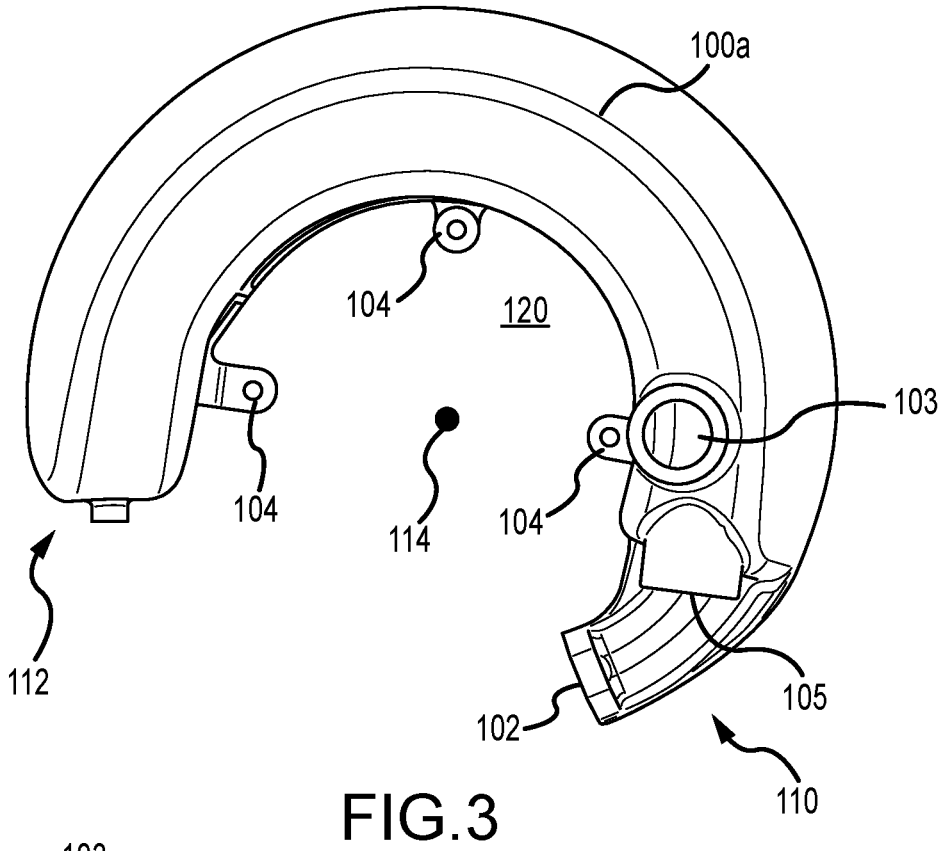
FIG. 3 is a top view of the muffler assembly of FIG. 1.
Figure 4:
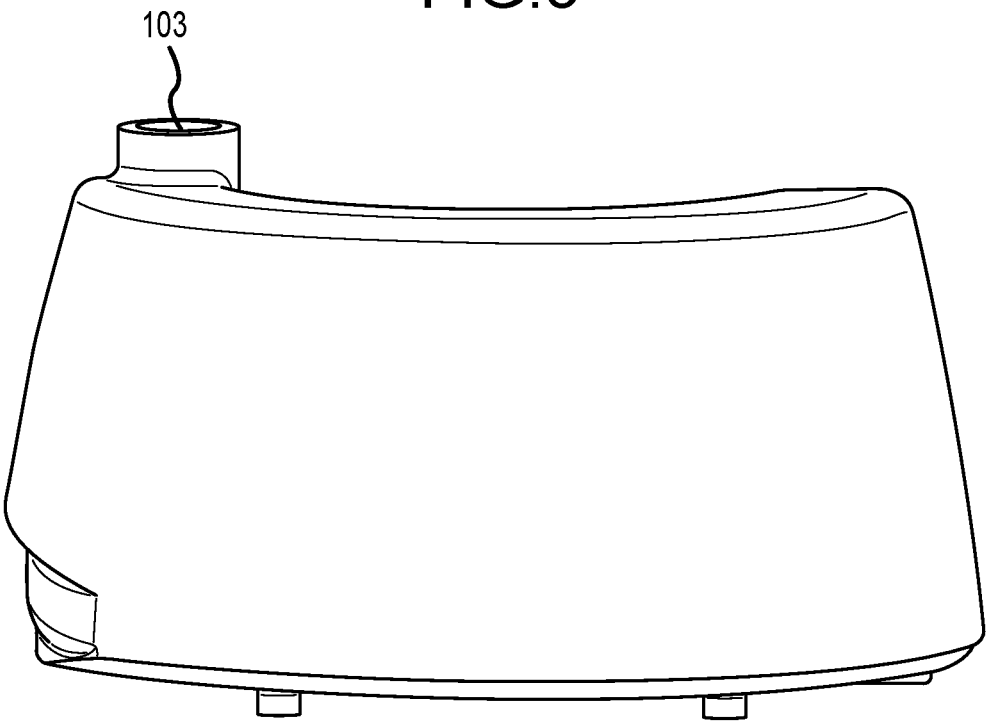
FIG. 4 is a view of the exterior (or atmospheric) side of the muffler assembly of FIG. 1.
Figure 5:
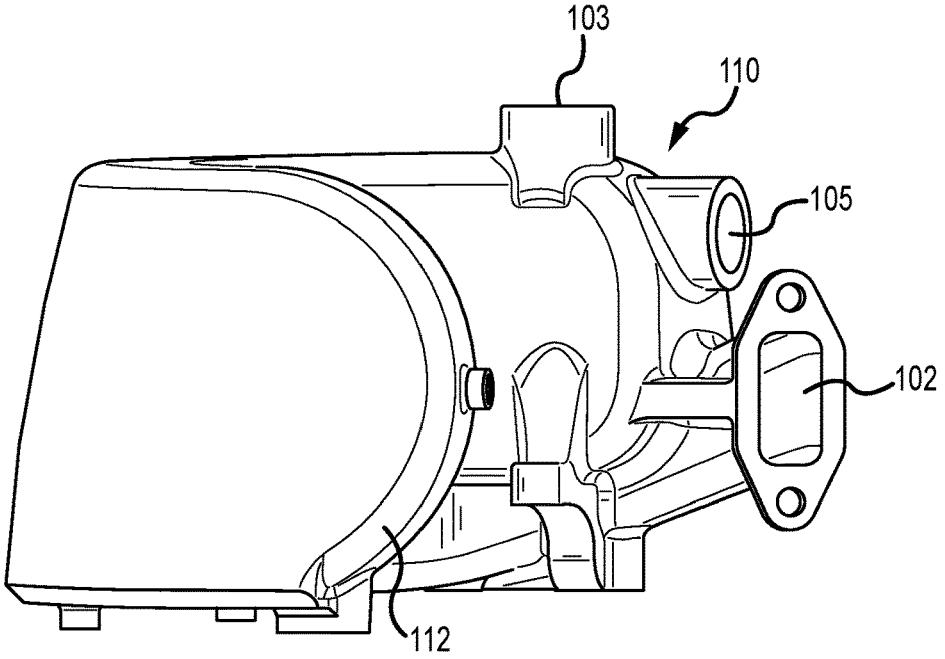
FIG. 5 is a side view of the muffler assembly of FIG. 1, with attention to the exhaust intake flange and alternative stinger exhaust port locations.

Referring to FIGS. 1-6, the main body of a muffler or muffler assembly 100 is disclosed. The muffler 100 is comprised of a cast muffler body 100*a* with an integrated exhaust intake port 102 (and a corresponding flange for mounting the muffler 100 to an engine assembly), packing access door (not shown), packing material (not shown), heat shield 101, and two exhaust outlet ports 103, 105 for alternate "stinger" exhaust locations (e.g., stinger 107 in FIG. 8 (pusher-type configuration); stinger 438 in FIG. 11*a* (pusher-type configuration)). The muffler 100 may be used in conjunction with a synchronous rotary exhaust valve 106 of the type disclosed in U.S. Pat. No. 9,255,502, incorporated by reference in its entirety herein (see FIG. 8).

Figure 7:
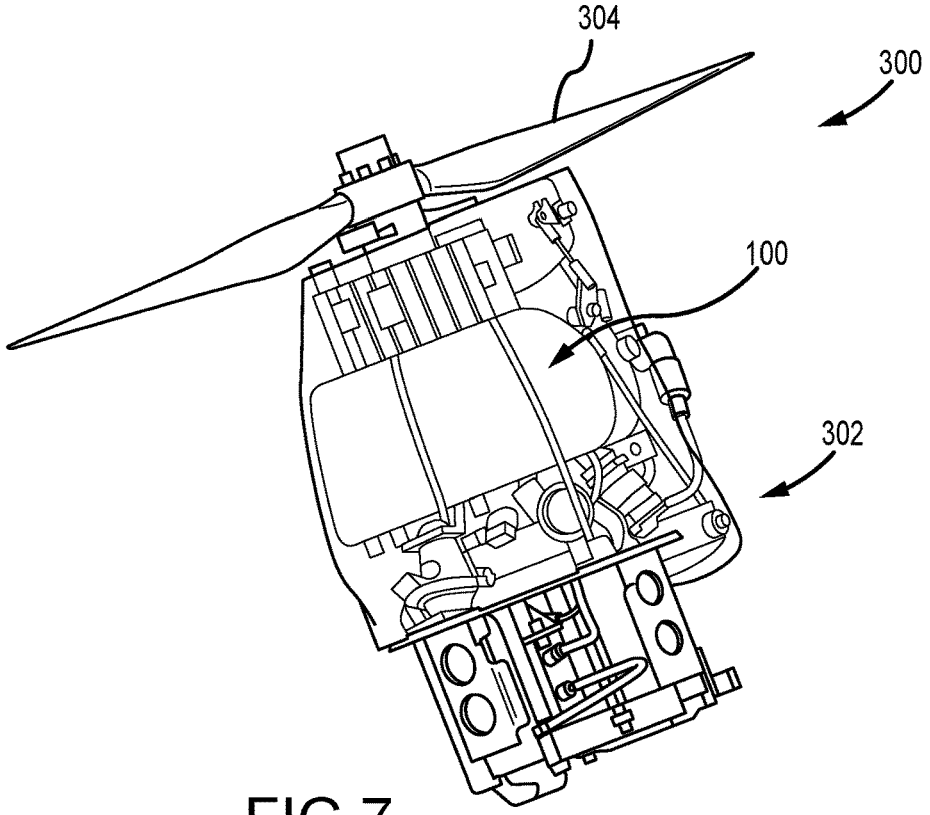
FIG. 7 is a perspective view showing an application of the muffler assembly of FIG. 1 to an embodiment of an engine assembly for an aircraft or aerial vehicle application.
Figure 8:
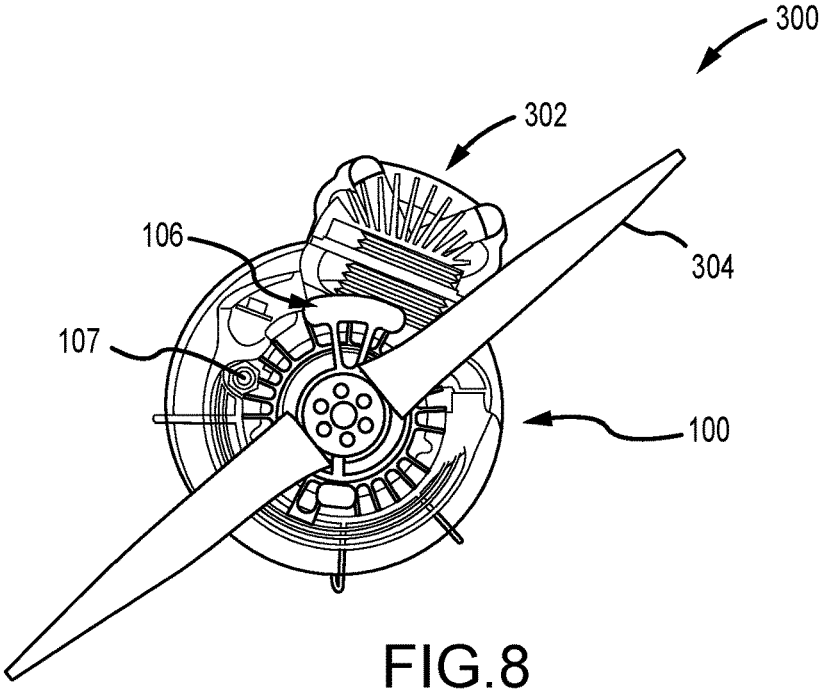
FIG. 8 is another view of the engine assembly shown in FIG. 7, as seen from the propeller assembly.

In a preferred embodiment, the muffler assembly 100 is mounted to a two-stroke engine assembly at the flange associated with the exhaust intake port 102 and at three positions corresponding with the engine mounting flanges 104. The muffler assembly 100 then becomes an integral and aerodynamic component of the engine module assembly (FIGS. 7 and 8). This is beneficial for unmanned aerial vehicles (UAVs), where the ability to encase the muffler fully within the engine periphery and within the engine compartment of an aircraft fuselage does not induce drag commonly produced by externalized exhaust systems. This integral design form facilitates the operation of the aircraft application with enhanced aerodynamic efficiency.

The exhaust intake port 102 is integrally cast into the muffler body 100*a*. The exhaust intake port 102 may form a slightly constricted duct through which exhaust gas are ported to the lower half or portion of the muffler body 100*a*. The terminus end of the duct may be lined with an aggregation of perforations designed as an initial disruption point for the entering gases, hence enabling the further optimization of back pressure values to the cylinder chamber.

Figure 11A:
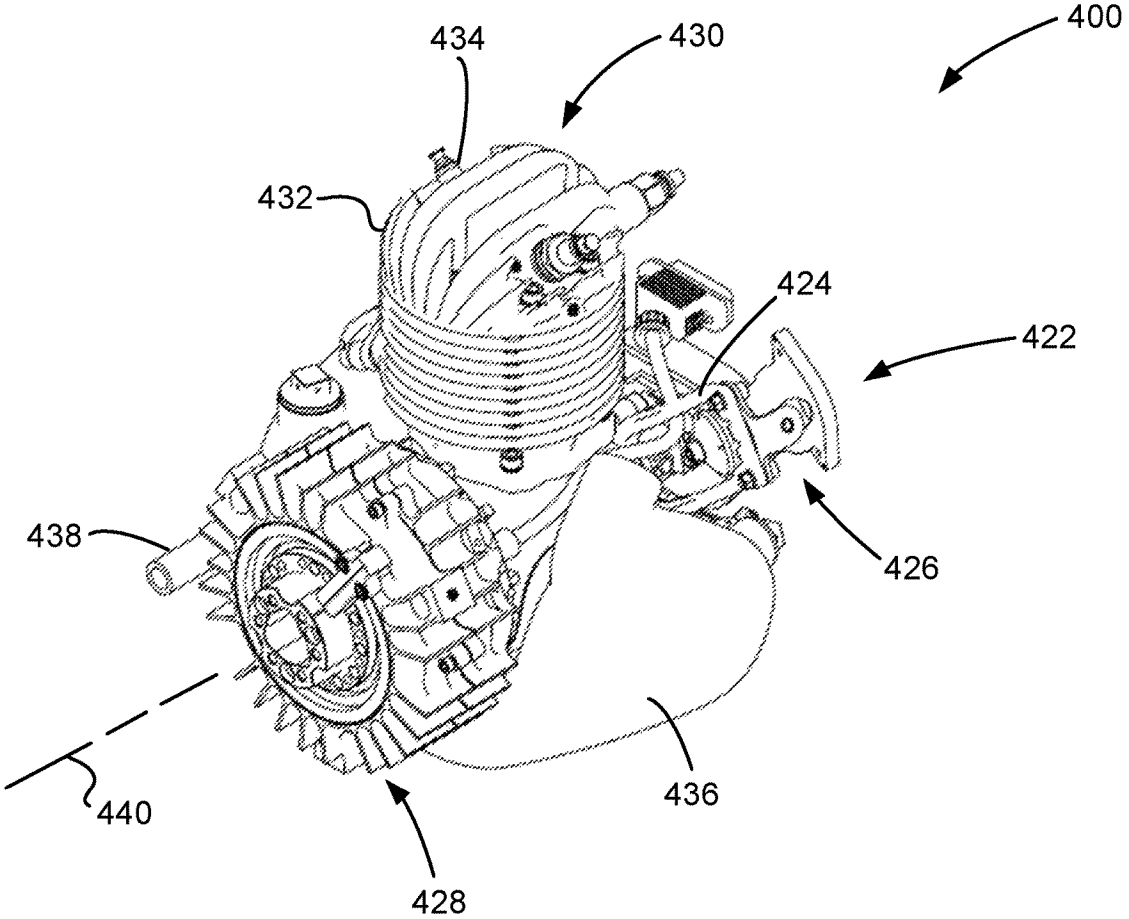
FIG. 11*a* is a perspective view of an embodiment of an engine assembly for an aircraft or aerial vehicle application, that uses the type of mounting system shown in FIG. 9, and that uses the type of muffler shown in FIGS. 1-6.

The exhaust gases travel through a lower chamber along the length of the muffler body 100*a* and then return to the inception end of the chamber along an upper chamber, approaching the exit aperture and the atmosphere by means of an exhaust port stinger (connected with either the exhaust outlet port 103 (e.g., stinger 107 in FIG. 8 (pusher-type configuration); stinger 438 in FIG. 11*a* (pusher-type configuration)) or the exhaust outlet port 105). The gas travel path and length are designed to separate in phase/time the peak pressure/noise wave from the peak flow rate.

The exhaust port stinger may be covered/blocked by the rotary exhaust valve 106 (FIG. 8; see also FIGS. 10*a* and 10*b*, discussed below), noted above, during a specific portion of the cycle to reflect the peak pressure/noise wave back into the muffler 100. The exhaust port stinger (e.g., stinger 107 in FIG. 8 (pusher-type configuration); stinger 438 in FIG. 11*a* (pusher-type configuration)) is open during the rest of the cycle to allow peak flow of the exhaust out of the muffler 100 through either the exhaust outlet port 103 or the exhaust outlet port 105.

The ceiling of the lower half and the floor of the upper half (FIG. 6) of the muffler 100 are lined with a pattern of perforations that allow exhaust gases to eventually escape from the exhaust chambers through a sound dampening material packed between the perforations. A non-woven glass fiber mat provides noise attenuation and pressure damping through the core and perimeter of the exhaust gas path. High pressure/high frequency gases entering the perforations undergo expansion and lose pressure and velocity. The sound damping packing dissipates the sound energy carried by the exhaust gases and the spent exhaust gases permeate to the upper chamber and exit to the atmosphere through the stinger.

The exact placement and pattern of the perforations along the upper chamber unit allow for the exhaust gas duct to function as an internal header pipe. The placement of the perforation pattern as well as the internal header is optimized to produce maximum performance of the example two-stroke engine to which the muffler 100 may be attached.

The design of the conformal muffler 100 allows for an equivalent length of the exhaust path as compared to straight-line traditional packed mufflers as known in the art. The curved exhaust path from the lower to upper muffler chambers in the conformal muffler 100 creates an exhaust path length approximately two times the length of the perceived exhaust path.

The design of the conformal muffler 100 includes two cast ports 103, 105 for the venting of exhaust gases into the atmosphere. This innovative feature allows for the conformal muffler 100 to be used on either tractor or pusher configuration propulsion systems. In either configuration, a single port is used to vent exhaust gases into the environment near the propeller assembly. This configuration enables optimum exhaust flow to the atmosphere while minimizing exhaust initiated turbulence in each of the propulsion directional configurations. When the conformal muffler 100 is applied to a tractor-type small engine configuration, the stinger exit is positioned to accept an exhaust flow out of the muffler body 100*a* through the exhaust outlet port 105 (e.g., where the exhaust flow would be discharged at least substantially parallel to a plane in which the associated propeller is rotating; where the exhaust flow would be discharged orthogonal to a direction of travel of a vehicle that incorporates the muffler 100). The second exhaust outlet port 103 is then blocked via a plug 116 (e.g., an aluminum standard threaded pipe fitting plug).

The conformal muffler 100, when applied to a pusher-type small engine configuration, allows for the stinger insertion into the exhaust outlet port 103 (e.g., located about 90 degrees from the exhaust outlet port 105; stinger 107 in FIG. 8; stinger 438 in FIG. 11*a*). In this application, the stinger is affixed to accept an exhaust flow out of the port 103 and with a plug 116 now being inserted into the exhaust outlet port 105). Again, the fitting utilized may be an aluminum standard threaded pipe fitting plug anchored into a helicoil insert in the port hole. In any case, the exhaust flow out of the stinger in this configuration (where the exhaust flow out of the muffler 100 is through the port 103) would be directed toward a plane in which the associated propeller is rotating for this pusher-type configuration (or opposite of the direction of travel of a vehicle that incorporates the muffler 100).

The muffler body 100*a* discussed above may be characterized as having a first end portion 110 and a second end portion 112 that are spaced from one another by the muffler body 100*a* proceeding about a reference axis 114. The muffler body 100*a* may be characterized as being arcuately-shaped in a plan view (where this reference axis 114 is represented by a dot or point, such as in FIG. 3). In one embodiment, the first end portion 110 and the second end portions 112 are spaced more than 180° from one another relative to and proceeding about the reference axis 114. Such a configuration for the muffler body 100*a* defines an engine assembly receptacle 120 in the form of an open space, and that accommodates receiving at least a portion of an engine assembly when the muffler 100 is in an installed configuration.

Figure 6:
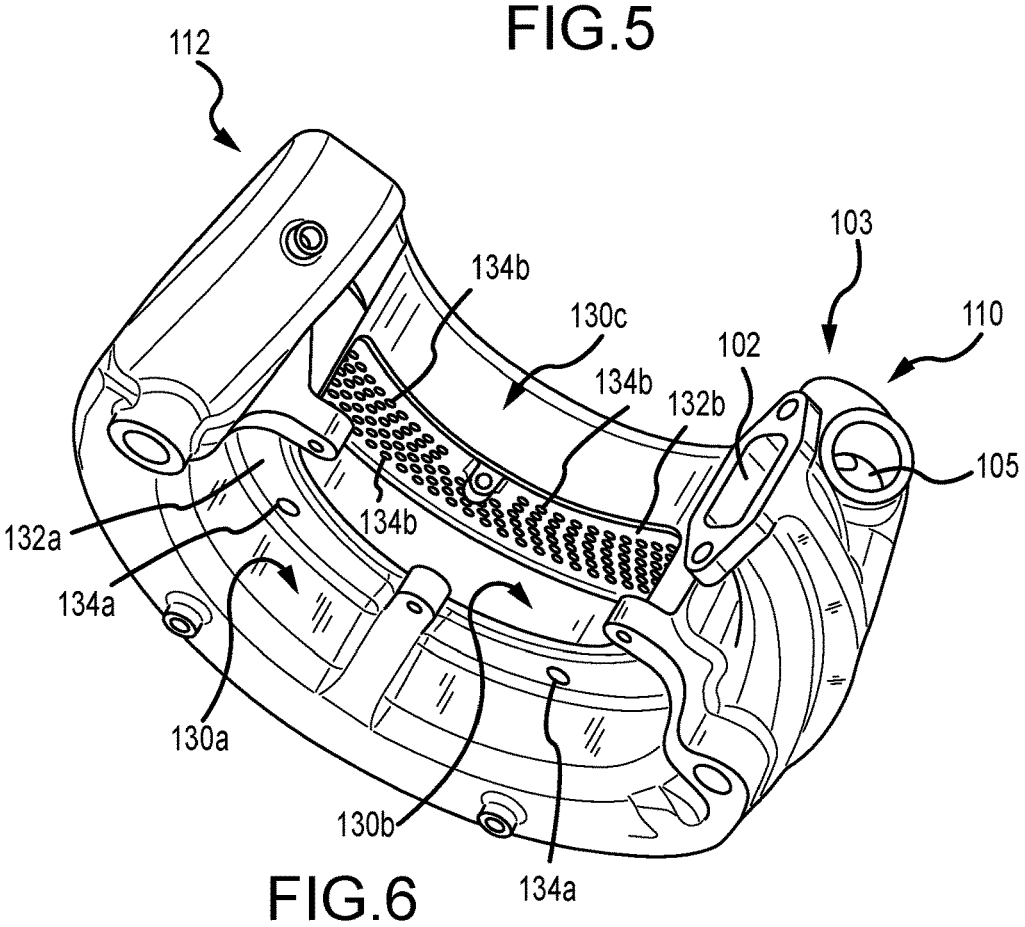
FIG. 6 is a perspective view that shows interior features of the muffler assembly of FIG. 1.

The above-described ports 102, 103, 105 of the muffler 100 may be characterized as being disposed at the first end portion 110 of the muffler body 100*a*. An exhaust flow entering the interior of the muffler body 100*a* through the exhaust inlet port 102 may flow more than 180° about/relative to the reference axis 114 in proceeding toward the second end portion 112 of the muffler body 100*a* (through a lower or first chamber 130*a* of the muffler 100), and the exhaust gas within the muffler body 100*a* may also flow more than 180° about/relative to the reference axis 114 in proceeding back to the first end portion 110 to exit the muffler body 100*a* either through the exhaust outlet port 103 or the exhaust outlet port 105 (through an upper or third chamber 130*c* of the muffler 100). A plate with perforations may separate the lower chamber 130*a* from an intermediate or second chamber 130*b*, while another plate (spaced along or relative to the reference axis 114) separates the intermediate chamber 130*b* from the upper chamber 130*c*, all as shown in FIG. 6. The exhaust intake port 102 directs an exhaust gas flow into the lower chamber 130*a*, while exhaust gas flowing within the upper chamber 130*c* may exit the muffler 100 through one of the exhaust outlet port 103 or the exhaust outlet port 105 (the other being capped or plugged).

Figure 6A:
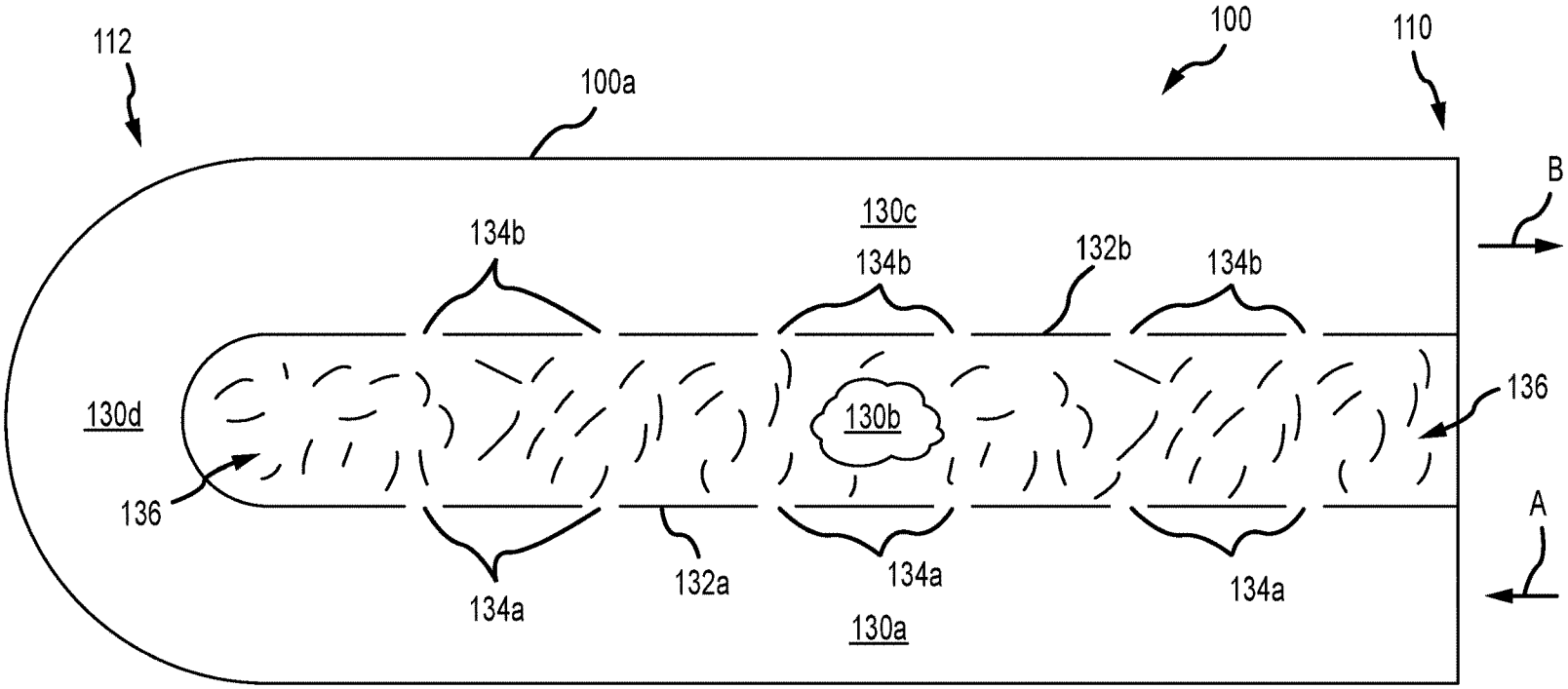
FIG. 6A is a schematic representation of the internal chambers of the muffler assembly of FIG. 1.

A schematic of the muffler body 100*a* to further illustrate the above-noted chambers 130*a*, 130*b*, and 130*c* is presented in FIG. 6A. Initially, each of the lower chamber 130*a*, the intermediate chamber 130*b*, and the upper chamber 130*c* extend between the first end portion 110 of the muffler body 100*a* and the second end portion 112 of the muffler body 100*a* and proceed about the reference axis 114. The intermediate chamber 130*b* is located between the lower chamber 130*a* and the upper chamber 130*c* proceeding along or relative to the reference axis 114, and includes a sound-dampening or packing material 136. As such, the lower chamber 130*a*, the intermediate chamber 130*b*, and the upper chamber 130*c* may be characterized as collectively defining a stack, with the intermediate chamber 130*b* being disposed between the lower chamber 130*a* and the upper chamber 130*c* within this stack.

A first partition or plate 132*a* is disposed between the lower chamber 130*a* and the intermediate chamber 130*b*, while a second partition or plate 132*b* is disposed between the intermediate chamber 130*b* and the upper chamber 130*c*. A plurality of first perforations or ports 134*a* extend through the first partition 132*a* to allow fluid communication between the lower chamber 130*a* and the intermediate chamber 130*b*. A plurality of second perforations or ports 134*b* extend through the second partition 132*b* to allow fluid communication between the intermediate chamber 130*b* and the upper chamber 130*c*.

Exhaust gases are directed into the lower chamber 130*a* through the exhaust inlet port 102 at the first end portion 110 of the muffler body 100*a* (represented by the arrow A in FIG. 6A). The primary flowpath for these exhaust gases is through the lower chamber 130*a* to a connecting chamber 130*d* at the second end portion 112 of the muffler body 100*a*. As such, exhaust gases may proceed more than 180° about the reference axis 114 in a first direction in flowing through the lower chamber 130*a* from the first end portion 110 of the muffler body 100*a* to its second end portion 112. The connecting chamber 130*d* provides a direct flowpath from the lower chamber 130*a* to the upper chamber 130*c* at the second end portion 112 of the muffler body 100*a*. Exhaust gases within the upper chamber 130*c* may thus proceed back in the direction of the first end portion 110 of the muffler body 100*a*. As such, these exhaust gases may proceed more than 180° about the reference axis 114 (in a second direction that is opposite of the above-noted first direction) in flowing through the upper chamber 130*c* from the second end portion 112 of the muffler body 100*a* to its first end portion 110. Notwithstanding the foregoing, exhaust gases may flow from the lower chamber 130*a* into the intermediate chamber 130*b* through one or more of the first ports 134*a*. Exhaust gases may flow from the intermediate chamber 130*b* into the upper chamber 130*c* through one or more of the second ports 134*b*. In any case, exhaust gases are directed out of the upper chamber 130*c* through either the exhaust outlet port 103 or the exhaust outlet port 105 at the first end portion 110 of the muffler body 100*a* (schematically represented by the arrow B).

Each port 134*a* and 134*b* has a cross-sectional area that is taken perpendicularly to a flow through the corresponding port 134*a*, 134*b*. The collective cross-sectional area of the first ports 134*a* (e.g., the sum of the cross-sectional area of each first port 134*a* in the first partition 132*a*) is less than the collective cross-sectional area of the second ports 134*b* (e.g., the sum of the cross-sectional area of each second port 134*b* in the second partition 132*b*). In one embodiment, the collective cross-sectional area of the first ports 134*a* is no more than about fifteen percent (15%) of the collective cross-sectional area of the second ports 134*b*. This accommodates the lower chamber 130*a* being located closer to the exhaust being discharged from the corresponding engine.

A representative engine assembly that may incorporate the muffler 100 is illustrated in FIGS. 7 and 8 and is identified by reference numeral 300. The engine assembly 300 may be used by an aircraft, helicopter, or other aerial vehicle of any appropriate type. The engine assembly 300 includes an internal combustion engine 302, a propeller 304 that is rotated by operation of the engine 302, and the noted muffler 100. The above-noted reference axis 114 for the muffler 100 is either aligned with (e.g., collinear) or parallel to the rotational axis for the propeller 304.

Figure 9:
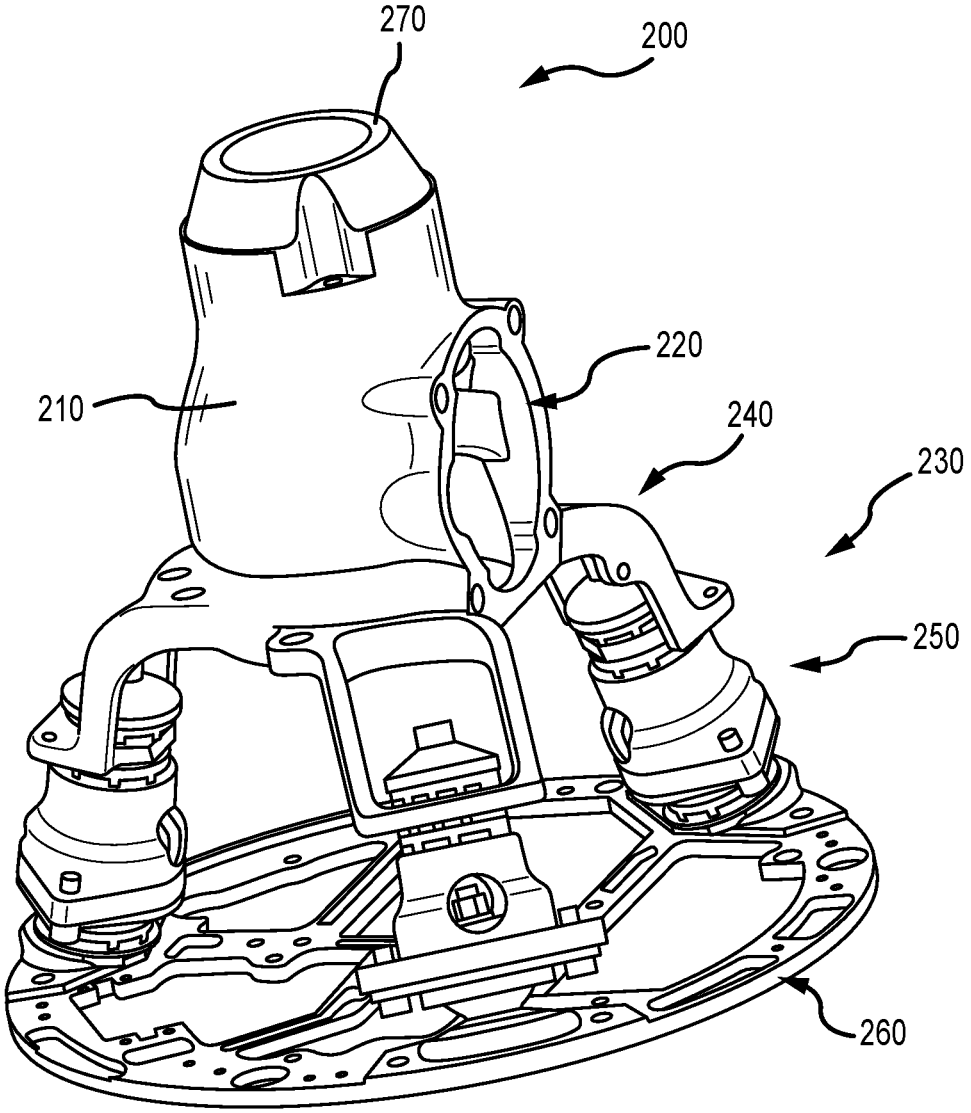
FIG. 9 is a perspective view of a portion of another embodiment of engine assembly, where part of an engine assembly mounting system is integrally formed with a crankcase housing of the engine assembly.

A representative engine assembly is illustrated in FIG. 9 and is identified by reference numeral 200. The engine assembly 200 includes an engine case or crankcase housing 210 (in which a rotatable crankshaft may be disposed). An engine or cylinder block may be mounted to the crankcase housing 210 at a mounting location 220, and a cylinder head may be appropriately mounted to this engine block. The engine block may be of any appropriate configuration (e.g., incorporating one or more cylinders, with each cylinder having a corresponding reciprocating piston disposed therein; where a crankshaft of the engine (disposed with the crankshaft housing 210) reciprocates one or more of these pistons in a timed relation). The cylinder head closes the upper end of the cylinder(s) being utilized by the engine, and may be configured to direct air and/or fuel into each of the cylinders of the engine as well as to allow exhaust gases to be discharged from each of the cylinders of the engine. The cylinder head may also include intake and/or exhaust valves, spark plugs, and the like. In any case, the cylinder head may be characterized as being aligned with the mounting location 220 on the crankcase housing 210, and may be directly or indirectly interconnected with the crankcase housing 210 at this mounting location 220.

The engine assembly 200 further includes an engine mounting system in the form of a plurality of mounting legs 230 that extend between the crankcase housing 210 and a mounting ring 260. The mounting ring 260 may be appropriately secured to an airframe of an aircraft or aerial vehicle (as well as to a bulkhead of a watercraft or power equipment). The engine assembly 300 shown in FIGS. 7 and 8 may be secured to such an airframe using this type of mounting system as well. In this case, a propeller or propeller assembly (for instance propeller 304—FIGS. 7 and 8) would be disposed beyond an end 270 of the crankcase housing 210.

Each mounting leg 230 includes an upper section 240 that may be integrally formed with the crankcase housing 210, as well as a lower section 250. The lower section 250 for each mounting leg 230 is in the form of a vibration damping or isolation subassembly, and each such lower section 250 may be of any appropriate configuration to provide the desired/required support and/or vibration damping/isolation effects. The engine assembly 200 of FIG. 9 may be utilized to integrate the engine assembly 300 of FIGS. 7 and 8 with an airframe of an aircraft, helicopter, or other aerial vehicle.

The muffler 100 discussed above in relation to FIGS. 1-6A may be mounted to the engine assembly 200 shown in FIG. 9 by aligning each of its mounting flanges 104 with a hole on an appropriate surface of a corresponding one of the mounting legs 230 (e.g., a portion of the mounting leg 230 positioned toward the end of the crankcase housing 210). As such, the above-discussed reference axis 114 for the muffler 100 may coincide with the rotational axis of the crankshaft or may be disposed parallel to this rotational axis for the crankshaft.

Figure 10A:
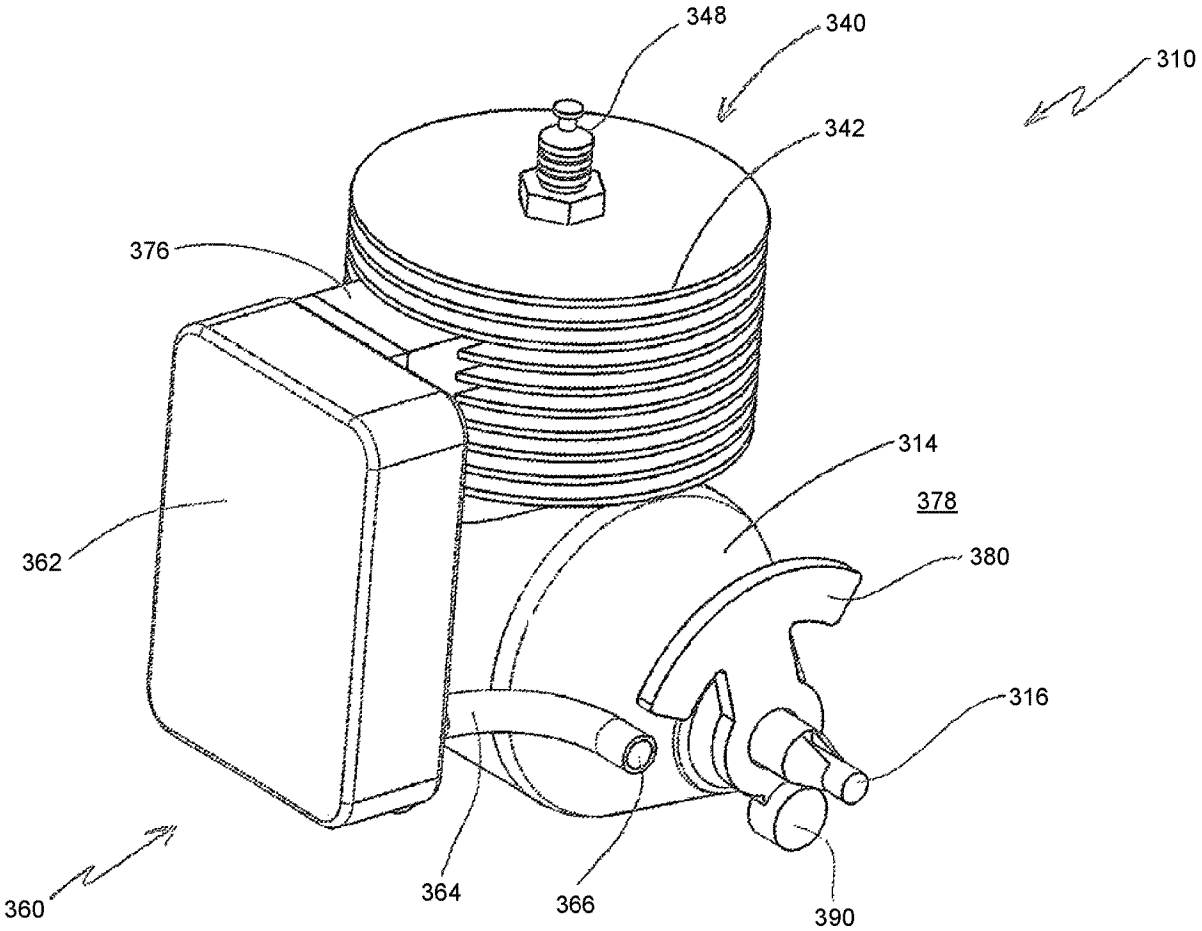
FIG. 10*a* is a perspective view of an embodiment of an internal combustion engine with an exhaust system reflector, with the exhaust system reflector being in a non-reflecting position for acoustic emissions being discharged from the exhaust system.
Figure 10B:
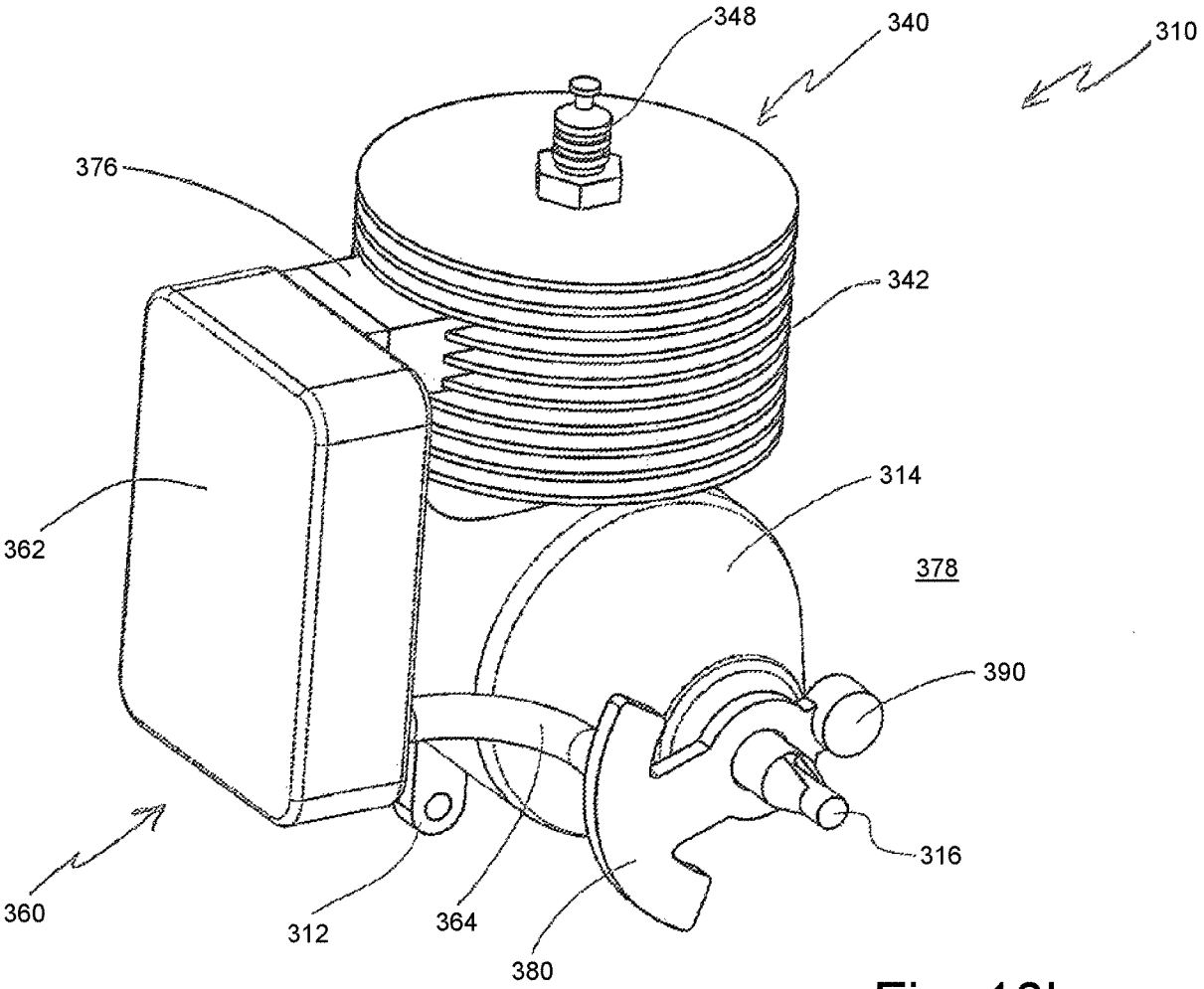
FIG. 10*b* is another perspective view of the internal combustion engine of FIG. 10*a*, with the exhaust system reflector being in a reflecting position for acoustic emissions being discharged from the exhaust system.

FIGS. 10*a* and 10*b* illustrate an embodiment of an internal combustion engine 310 that may be used by the engine 300 of FIGS. 7 and 8. Such an engine may be used in the propulsion of unmanned aerial vehicles, radio-controlled model aircraft, watercraft, and powered hand tools. The engine 310 includes a crankshaft 316, an engine case 314, a cylinder 340 (which may include one or more cooling fins 342 for removing heat generated during operation of the engine 310), one or more spark plugs or other igniters 348, an exhaust system 360, an exhaust system reflector 380 located downstream of the exhaust system 360, and a counterweight 390. The exhaust system reflector 380 and associated counterweight 390 may not be required for all applications. One or more engine mounts 312 may be utilized for securing the engine 310 relative to a vehicle of any appropriate type, such as an unmanned aerial vehicle, or relative to any appropriate supporting structure. Rotation of the crankshaft 316 may rotate a propeller (e.g., propeller 304 for the engine assembly 300—FIGS. 7 and 8) may rotate an axle or propulsor (in the case of a watercraft), or the like.

The exhaust system 360 for the engine 310 includes a muffler 362 that receives a discharge or exhaust/exhaust flow from the cylinder 340 during operation of the engine 310 and via an exhaust header 376 that fluidly interconnects the cylinder 340 and the muffler 362. The muffler 100 addressed herein may be used in place of the muffler 362. In this case, the reference axis 114 of the muffler 100 could be integrated such that its reference axis 114 is either aligned with (e.g., collinear) or parallel to the crankshaft 316.

An exhaust conduit 364 (e.g., a tailpipe or stinger) extends from the muffler 362 and includes an open end or exhaust discharge port 366. As such, exhaust from the cylinder 340 flows into/through the header 376, then into/through the muffler 362, and then into/through the exhaust conduit 364 such that the exhaust exits through the open end 366 of the exhaust conduit 364 and into the atmosphere 378.

The exhaust flowing out of the exhaust system 360 through the open end 366 of the exhaust conduit 364 may be characterized as including two primary components—a bulk exhaust gas flow and acoustic emissions (e.g., one or more acoustic waves). The exhaust system reflector 380 is used by the engine 310 to force at least a part of the acoustic emissions (after having exited the exhaust system 360 through the open end 366 of the exhaust conduit 364, or at least after having reached the open end 366 of the exhaust conduit 364 back into the exhaust conduit 364 (via its open end 366) and preferably then back into the muffler 362. This reflection and/or obstruction of at least part of the acoustic emissions should dampen the acoustic emissions (e.g., further lower the acoustic emissions from operation of the engine 310; accommodate additional acoustic wave destructive interference) more than if the acoustic emissions make a single pass through the muffler 362 in proceeding from the cylinder 340 to the exhaust conduit 364. In addition to the foregoing, the reflector 380 should also be sized and timed (relative to the position of the open end 366 of the exhaust conduit 364) to reduce the potential of an unacceptable amount of the bulk exhaust gas flow being redirected or obstructed by the reflector 380, which could generate a back pressure in the muffler 362 and the cylinder 340, which in turn could adversely affect the operational performance of the engine 310. Preferably at most only a very minor amount of the bulk exhaust gas flow is reflected or obstructed by the exhaust system reflector 380 at any time. As such, the reflector 380 may also be referred to as an acoustic emissions valve 380 that is positioned downstream of the exhaust system 360. Such an acoustic emissions valve 380 may be moved into a position (by the crankshaft 316) so as to reflect or obstruct acoustic emissions, but may be moved out of this position (by the crankshaft 316) so as to not obstruct the bulk exhaust gas flow that has exited the exhaust system 360.

The exhaust system reflector 380 may be integrated with the crankshaft 316 in any appropriate manner so that the exhaust system reflector 380 and the crankshaft 316 rotate in unison—the reflector 380 will rotate 360° each time that the crankshaft 316 rotates 360° in the case of an engine with a single cylinder head. The reflector 380 could be separately attached to the crankshaft 316 in any appropriate manner, the reflector 380 could actually be part of the crankshaft 316, or the like. The counterweight 390 may also be incorporated by the crankshaft 316 in any appropriate manner so that the counterweight 390 and the crankshaft 316 also rotate in unison—the counterweight 390 will rotate 360° each time that the crankshaft 316 rotates 360°. The counterweight 390 could be separately attached to the crankshaft 316 in any appropriate manner, the counterweight 390 could actually be part of the crankshaft 316, or the like. In the illustrated embodiment, the counterweight 390 is mounted 180° from the reflector 380 relative to a rotational axis of the crankshaft 316 (e.g., the counterweight 390 and reflector 380 are disposed in opposing relation relative to the crankshaft 316). The counterweight 390 functions to maintain an appropriate rotational balance for the crankshaft 316. Other configurations where rotation of the crankshaft 316 moves the reflector 380 in the manner to be described herein may be utilized by the engine 310.

The reflector 380 is located outside of the exhaust system 360. The exhaust system 360 discharges to the atmosphere 378. As such, the reflector 380 is located within the atmosphere 378. In order to reflect at least part of the acoustic emissions back into the exhaust system 360, but to not reflect any substantial portion of the bulk exhaust gas flow back into the exhaust system 360, the reflector 380 is rotated into and out of alignment with the open end 366 of the exhaust conduit 364 through rotation of the crankshaft 316. "In alignment" in relation to the relative positioning of the reflector 380 and the open end 366 of the exhaust conduit 364 means that at least part the flow out of the open end 366 of the exhaust conduit 364 impacts the reflector 380 in a manner that reflects at least part of this flow back into the exhaust system 360 (where this flow is in the form of acoustic emissions in this instance). "Out of alignment" in relation to the relative positioning of the reflector 380 and the open end 366 of the exhaust conduit 364 means that the flow out of the open end 366 of the exhaust conduit 364 does not impact the reflector 380 in a manner that obstructs flow out of the exhaust system 360 (where this flow is in the form of the bulk exhaust gas flow in this instance). It should be appreciated that in certain instances the reflector 380 will be blocking/reflecting only a portion of the flow exiting the exhaust system 360 (e.g., as the reflector 380 is being rotated into alignment with the open end 366 of the exhaust conduit 364, and where the flow in this instance is in the form of acoustic emissions).

Figure 10C:
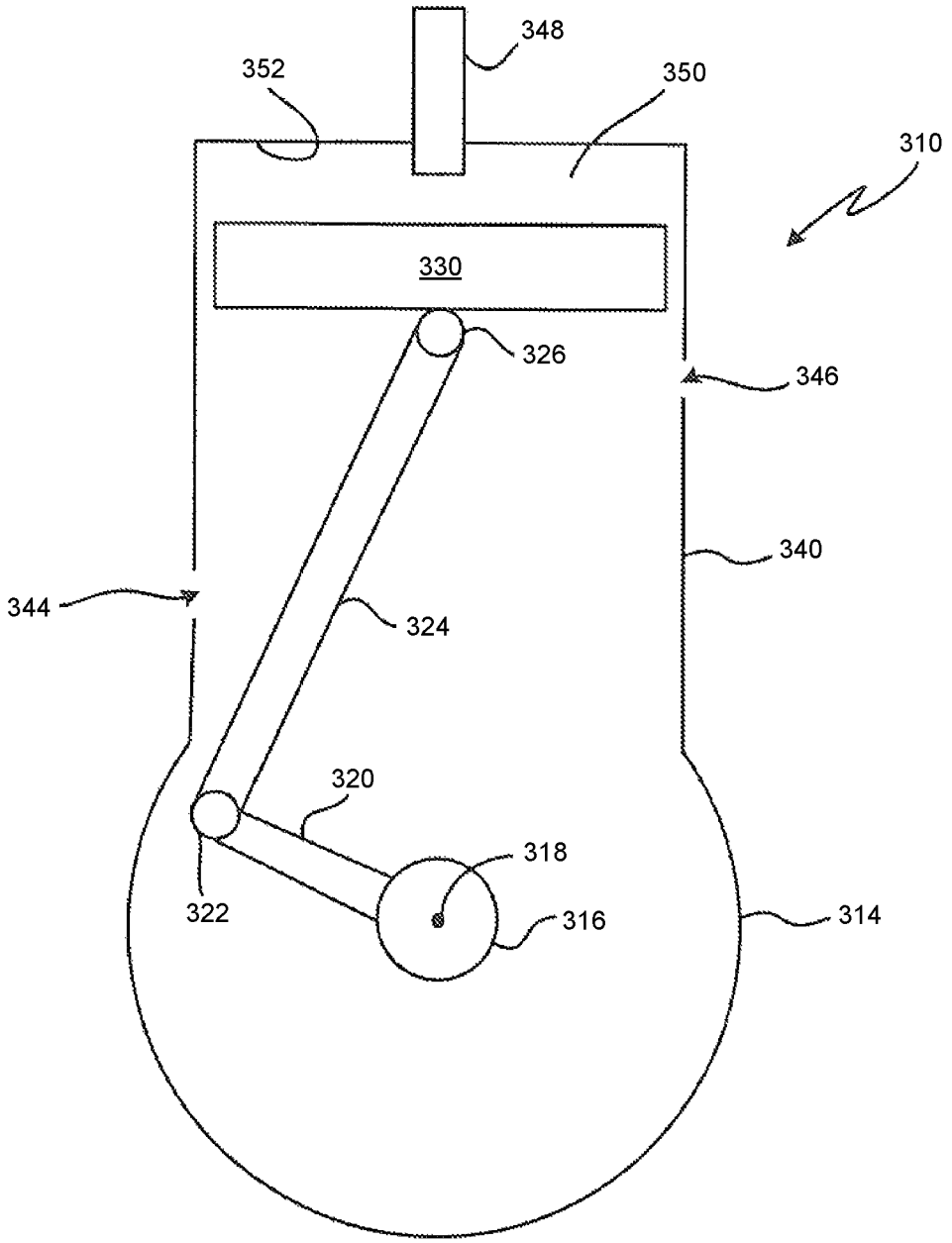
FIG. 10*c* is a schematic of one configuration of a cylinder for the internal combustion engine of FIG. 10*a*, along with a corresponding piston.

A schematic of a portion of the internal combustion engine 310 is presented in FIG. 10*c*. The engine 310 may use one or more cylinders 340, and furthermore may be of a two-cycle configuration. A piston 330 reciprocates within the cylinder 340. In this regard, a connecting rod 320 is appropriately fixed relative to a crankshaft 316 and extends to a pivot 322. A piston rod 324 extends from the pivot 322 to another pivot 326 associated with the piston 330. As such, rotation of the crankshaft 316 about its rotational axis 318 will drive the piston 330 up and down in alternating fashion (in the view shown in FIG. 10*c*).

The cylinder 340 includes an intake port 344 and an exhaust port 346. One or more valves may be associated with one or more of the ports 344, 346. An air/fuel mixture may be directed into the engine case 314 through the intake port 344 during movement of the piston 330 from a bottom dead center position toward a top dead center position (after the piston 330 passes the intake port 344). This movement of the piston 330 also compresses the air/fuel mixture that is contained within the combustion chamber 350 (located between the piston 330 and a closed end 352 of the cylinder 340, and directed into the chamber 350 through the intake port 344/engine case 314). At some point in time during the movement of the piston 330 toward its top dead center position, the piston 330 will isolate the exhaust port 346 from the combustion chamber 350.

When the piston 330 reaches (or is at least near) its top dead center position, a spark plug or igniter 348 ignites the air/fuel mixture within the combustion chamber 350, which drives the piston 330 from its top dead center position back toward its bottom dead center position. At some point in time during the movement of the piston 330 toward its bottom dead center position, the exhaust port 346 will be exposed to the combustion chamber 350 to allow a flow of exhaust out of the combustion chamber 350, through the exhaust port 346, and into the above-discussed exhaust system 360 (e.g., into/through the exhaust header 376, and then into/through the muffler 362, and then into/through the exhaust conduit 364). Movement of the piston 330 toward its bottom dead center position will at some point in time compress the air/fuel mixture that has previously entered the engine case 314 through the intake port 344.

Figure 11B:
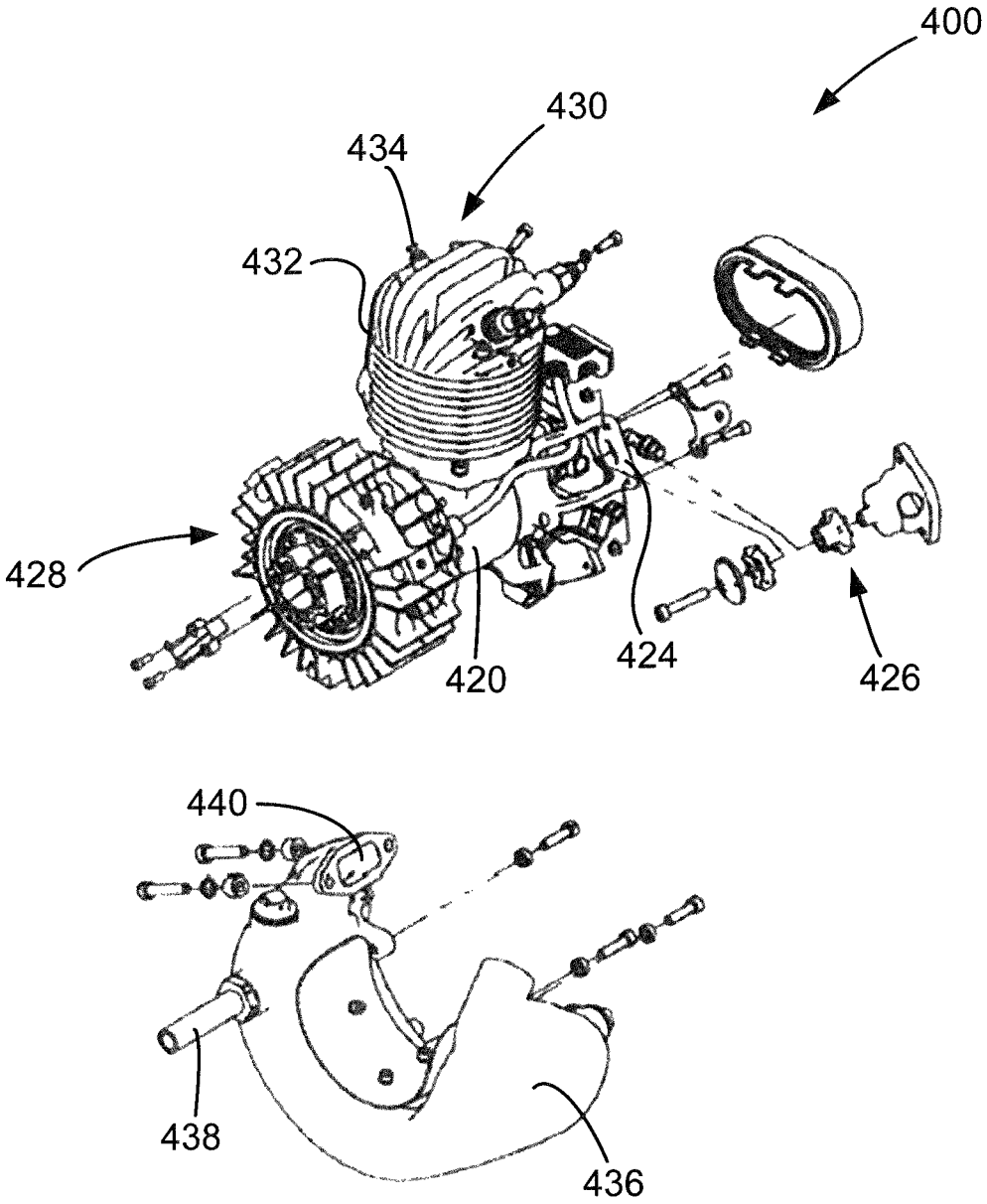
FIG. 11*b* a partially exploded, perspective view of the engine assembly shown in FIG. 10*a*.

A representative engine assembly is illustrated in FIGS. 11*a* and 11*b* and is identified by reference numeral 400. The engine assembly 400 includes an engine case or crankcase housing 420 in which a rotatable crankshaft may be disposed (for instance at least generally in accordance with crankcase housing 210—FIG. 9). A relevant portion of internal combustion engine 430 may be mounted to the crankcase housing 420 at least generally in the above-noted manner. In the illustrated embodiment, the engine 430 includes a single cylinder head 432 having a single combustion chamber. An air/fuel mixture within this combustion chamber is ignited by a pair of spark plugs 434. Exhaust gases may be discharged from this combustion chamber into a muffler 436, and thereafter may be directed into the environment through a stinger 438. The engine assembly 400 shown in FIGS. 11*a* and 11*b* is of a push-type configuration—the airframe or body of the associated aircraft/aerial vehicle would be pushed through the air by operation of the engine 430 and rotation of the associated propeller.

The muffler 436 in FIGS. 11*a* and 11*b* proceeds about the crankcase housing 420 (e.g., about rotational axis 440), and may include an exhaust intake port 440 (for instance at least generally in accordance with exhaust intake port 102—FIGS. 1-6). A flange associated with this exhaust intake port 440 may be secured to an exhaust header (not shown) of the cylinder head 432. The stinger 438 may extend out of an exhaust outlet port (for instance at least generally in accordance with exhaust outlet port 103—FIGS. 1-6) for the muffler 436. Exhaust gases may pass through the muffler 436 in the manner discussed above with regard to the muffler 100.

The engine assembly 400 further includes an engine assembly mounting system in the form of a plurality of mounting legs 422 (for instance at least generally in accordance with mounting legs 230—FIG. 9) that extend between the crankcase housing 420 and a mounting ring (not shown, but for instance at least generally in accordance with mounting ring 260—FIG. 9). Each mounting leg 422 includes an upper section 424 (for instance at least generally in accordance with upper section 240—FIG. 9) that may be integrally formed with the crankcase housing 420, as well as a lower section 426 (for instance at least generally in accordance with lower section 250—FIG. 9).

The engine assembly 400 of FIGS. 11*a* and 11*b* may be mounted to an airframe of an aircraft or aerial vehicle (for instance at least generally in accordance with the discussion of FIG. 9). In this case, the engine assembly 400 includes a propeller assembly 428. Operation of the engine 430 rotates a crankshaft within the crankcase housing 420, which in turn rotates the propeller assembly 428 about a rotational axis 440. The propeller assembly 428 would of course include a propeller of any appropriate type/configuration (for instance propeller 304—FIGS. 7 and 8) and that would be disposed on the free end of the propeller assembly 428 shown in FIGS. 11*a* and 11*b*. As exhaust gases will be discharged out of the stinger 438 in the direction of a plane in which such a propeller will rotate, the engine assembly 400 could utilize the exhaust system reflector 380 used by the engine 310 of FIGS. 11*a* and 11*b*.

The invention has been described in an illustrative manner and it is to be understood that the terminology which has been used is intended to be in the nature of words of description rather than of limitation. Other embodiments and configurations of the invention are possible during the continued development of the current desired engine configuration and alternative applications. The following claims are also in accordance with the invention.

What is claimed is:

1. A muffler assembly, comprising:

a muffler body comprising first and second end portions, wherein said muffler body proceeds about a first reference axis in a first direction from said first end portion to said second end portion, wherein said second end portion is closed, and wherein said first and second end portions of said muffler body are spaced more than 180° apart relative to said first reference axis and proceeding about said first reference axis in said first direction from said first end portion to said second end portion;

a first open space extending from said first end portion to said second end portion proceeding about said first reference axis in a second direction from said first end portion to said second end portion, wherein said first and second directions are opposite of one another;

a first flowpath that is within said muffler body, that also proceeds about said first reference axis, and that comprises first and second portions that are separated by a first partition within said muffler body, wherein said first portion of said first flowpath proceeds from said first end portion to said second end portion about said first reference axis in said first direction and on one side of said first partition, and wherein said second portion of said first flowpath proceeds from said second end portion back to said first end portion about said first reference axis in said second direction and on an opposite side of said first partition;

an exhaust inlet port to said muffler body and in fluid communication with said first flowpath;

a first exhaust outlet port from said muffler body and in fluid communication with said first flowpath; and an engine assembly receptacle in the form of a second open space that is disposed inwardly of said muffler body in relation to said first reference axis.

2. The muffler assembly of claim 1, wherein said first flowpath proceeds more than 180° about said first reference axis in flowing from said exhaust inlet port toward said second end portion of said muffler body.

3. The muffler assembly of claim 1, wherein said first portion of said first flowpath proceeds more than 180° about said first reference axis in said first direction, and wherein said second portion of said first flowpath proceeds more than 180° about said first reference axis in said second direction.

4. The muffler assembly of claim 1, wherein said exhaust inlet port and said first exhaust outlet port are each at said first end portion of said muffler body.

5. The muffler assembly of claim 4, further comprising:

a second exhaust outlet port from said muffler body and in fluid communication with said first flowpath, wherein said second exhaust outlet port is also at said first end portion of said muffler body.

6. The muffler assembly of claim 5, wherein said first and second exhaust outlet ports discharge an exhaust flow in different directions.

7. The muffler assembly of claim 5, wherein said first and second exhaust outlet ports project in first and second directions that are orthogonal to one another.

8. The muffler assembly of claim 5, further comprising:

a plug removably disposed in one of said first exhaust outlet port and said second exhaust outlet port.

9. The muffler assembly of claim 5, wherein said first exhaust outlet port is used for a first aircraft configuration, wherein said second exhaust outlet port is used for a second aircraft configuration, wherein said first aircraft configuration is a pull-type configuration, and wherein said second aircraft configuration is a pusher-type configuration.

10. The muffler assembly of claim 1, further comprising:

a second exhaust outlet port from said muffler body and in fluid communication with said first flowpath, wherein said first and second exhaust outlet ports discharge an exhaust flow in different directions.

11. A vehicle comprising an engine assembly and the muffler assembly of claim 1, wherein said engine assembly is disposed within said engine assembly receptacle of said muffler assembly, and wherein said muffler assembly does not protrude beyond an outermost perimeter of said engine assembly.

12. The vehicle of any of claim 11, wherein said first reference axis is either aligned with or parallel to a crankshaft of said engine assembly.

13. The vehicle of claim 11, wherein said vehicle comprises a propeller having a rotational axis, wherein said wherein said first reference axis is either aligned with or parallel to said rotational axis.

14. The vehicle of claim 11, wherein said muffler assembly further comprises:

a second exhaust outlet port from said muffler body and in fluid communication with said first flowpath, wherein said first and second exhaust outlet ports discharge an exhaust flow in different directions.

15. The vehicle of claim 14, wherein said vehicle comprises a propeller that is integrated for a pusher-type configuration, wherein said first exhaust outlet port is open and directs an exhaust flow in the direction of said propeller, and wherein said second exhaust outlet port is plugged.

16. The vehicle of claim 14, wherein said vehicle comprises a propeller that is integrated for a pull-type configuration, wherein said second exhaust outlet port is open and directs an exhaust flow parallel to a plane in which said propeller rotates, and wherein said first exhaust outlet port is plugged.

17. The muffler assembly of claim 1, wherein said muffler body further comprises:

a first chamber, wherein said exhaust inlet port leads into said first chamber;

a second chamber comprising a packing material, wherein said first partition is between said first chamber and said second chamber, and wherein said first partition comprises at least one first flow port;

a third chamber, wherein said first exhaust outlet port leads out of said third chamber;

a second partition between said second chamber and said third chamber, wherein said second partition comprises at least one second flow port;

wherein each of said first chamber, said second chamber, and said third chamber extend from said first end portion to said second end portion and proceed about said first reference axis; and wherein said second chamber is located between said first chamber and said third chamber proceeding along said first reference axis.

18. The muffler assembly of claim 17, wherein said first partition comprises a plurality of said first flow ports, wherein said second partition comprises a plurality of said second flow ports, wherein a collective cross-sectional area of said first flow ports is less than a collective cross-sectional area of said second flow ports, and wherein a cross-sectional area is taken perpendicular to a flow through a flow port.

19. A muffler assembly, comprising:

a muffler body comprising first and second end portions, wherein said muffler body proceeds about a first reference axis in a first direction from said first end portion to said second end portion;

a first open space extending from said first end portion to said second end portion proceeding about said first reference axis in a second direction from said first end portion to said second end portion, wherein said first and second directions are opposite of one another;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath;

a second exhaust outlet port from said muffler body and in fluid communication with said first flowpath;

a plug removably disposed in one of said first exhaust outlet port and said second exhaust outlet port, wherein said first exhaust outlet port discharges an exhaust flow in a first discharge direction when said plug is disposed in said second exhaust outlet port, wherein said second exhaust outlet port discharges an exhaust flow in a second discharge direction when said plug is disposed in said first exhaust outlet port, and wherein said first and second discharge directions are different; and an engine assembly receptacle in the form of a second open space that is disposed inwardly of said muffler body in relation to said first reference axis.

20. The muffler assembly of claim 19, wherein said second end portion of said muffler body is closed, and wherein said first and second end portions of said muffler body are spaced more than 180° apart relative to said first reference axis and proceeding about said first reference axis in said first direction from said first end portion to said second end portion.

21. The muffler assembly of claim 20, wherein said first flowpath comprises first and second portions that are separated by a first partition within said muffler body, wherein said first portion of said first flowpath proceeds from said first end portion to said second end portion about said first reference axis in said first direction and on one side of said first partition, and wherein said second portion of said first flowpath proceeds from said second end portion back to said first end portion about said first reference axis in said second direction and on an opposite side of said first partition.

22. The muffler assembly of claim 21, wherein said exhaust inlet port, said first exhaust outlet port, and said second exhaust outlet port are each at said first end portion of said muffler body.

23. The muffler assembly of claim 19, wherein said exhaust inlet port, said first exhaust outlet port, and said second exhaust outlet port are each at said first end portion of said muffler body.

24. The muffler assembly of claim 19, wherein said first and second discharge directions are orthogonal to one another.

25. The muffler assembly of claim 19, wherein said first exhaust outlet port is used for a first aircraft configuration, wherein said second exhaust outlet port is used for a second aircraft configuration, wherein said first aircraft configuration is a pull-type configuration, and wherein said second aircraft configuration is a pusher-type configuration.

26. A vehicle comprising an engine assembly and the muffler assembly of claim 19, wherein said engine assembly is disposed within said engine assembly receptacle of said muffler assembly, and wherein said muffler assembly does not protrude beyond an outermost perimeter of said engine assembly.

27. The vehicle of any of claim 26, wherein said first reference axis is either aligned with or parallel to a crankshaft of said engine assembly.

28. The vehicle of claim 26, wherein said vehicle comprises a propeller having a rotational axis, wherein said wherein said first reference axis is either aligned with or parallel to said rotational axis.

29. The vehicle of claim 26, wherein said vehicle comprises a propeller that is integrated for a pusher-type configuration, wherein said first exhaust outlet port is open and directs an exhaust flow in the direction of said propeller, and wherein said second exhaust outlet port is plugged.

30. The vehicle of claim 26, wherein said vehicle comprises a propeller that is integrated for a pull-type configuration, wherein said second exhaust outlet port is open and directs an exhaust flow parallel to a plane in which said propeller rotates, and wherein said first exhaust outlet port is plugged.

31. The muffler assembly of claim 19, wherein said muffler body further comprises:

a first chamber, wherein said exhaust inlet port leads into said first chamber;

a second chamber comprising a packing material;

a first partition between said first chamber and said second chamber, wherein said first partition comprises at least one first flow port;

a third chamber, wherein each of said first and second exhaust outlet ports lead out of said third chamber;

a second partition between said second chamber and said third chamber, wherein said second partition comprises at least one second flow port;

wherein each of said first chamber, said second chamber, and said third chamber extend from said first end portion to said second end portion and proceed about said first reference axis; and wherein said second chamber is located between said first chamber and said third chamber proceeding along said first reference axis.

32. The muffler assembly of claim 31, wherein said first partition comprises a plurality of said first flow ports, wherein said second partition comprises a plurality of said second flow ports, wherein a collective cross-sectional area of said first flow ports is less than a collective cross-sectional area of said second flow ports, and wherein a cross-sectional area is taken perpendicular to a flow through a flow port.

33. A muffler assembly, comprising:

a muffler body comprising first and second end portions, wherein said muffler body proceeds about a first reference axis between said first and second end portions;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath, wherein said exhaust inlet port and said first exhaust outlet port are each at said first end portion of said muffler body;

a second exhaust outlet port from said muffler body and in fluid communication with said first flowpath, wherein said second exhaust outlet port is also at said first end portion of said muffler body, and wherein said first and second exhaust outlet ports project in first and second directions that are orthogonal to one another; and an engine assembly receptacle in the form of an open space that is disposed inwardly of said muffler body in relation to said first reference axis.

34. A muffler assembly, comprising:

a muffler body comprising first and second end portions, wherein said muffler body proceeds about a first reference axis between said first and second end portions;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath, wherein said exhaust inlet port and said first exhaust outlet port are each at said first end portion of said muffler body;

a second exhaust outlet port from said muffler body and in fluid communication with said first flowpath, wherein said second exhaust outlet port is also at said first end portion of said muffler body, wherein said first exhaust outlet port is used for a first aircraft configuration, wherein said second exhaust outlet port is used for a second aircraft configuration, wherein said first aircraft configuration is a pull-type configuration, and wherein said second aircraft configuration is a pusher-type configuration; and an engine assembly receptacle in the form of an open space that is disposed inwardly of said muffler body in relation to said first reference axis.

35. A vehicle comprising an engine assembly and a muffler assembly, said muffler assembly comprising:

a muffler body comprising first and second end portions, wherein said muffler body proceeds about a first reference axis between said first and second end portions;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath;

a second exhaust outlet port from said muffler body and in fluid communication with said first flowpath, wherein said first and second exhaust outlet ports discharge an exhaust flow in different directions; and an engine assembly receptacle in the form of an open space that is disposed inwardly of said muffler body in relation to said first reference axis;

wherein said engine assembly is disposed within said engine assembly receptacle of said muffler assembly, and wherein said muffler assembly does not protrude beyond an outermost perimeter of said engine assembly; and wherein said vehicle comprises a propeller that is integrated for a pusher-type configuration, wherein said first exhaust outlet port is open and directs an exhaust flow in the direction of said propeller, and wherein said second exhaust outlet port is plugged.

36. A vehicle comprising an engine assembly and a muffler assembly, said muffler assembly comprising:

a muffler body comprising first and second end portions, wherein said muffler body proceeds about a first reference axis between said first and second end portions;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath;

a second exhaust outlet port from said muffler body and in fluid communication with said first flowpath, wherein said first and second exhaust outlet ports discharge an exhaust flow in different directions; and an engine assembly receptacle in the form of an open space that is disposed inwardly of said muffler body in relation to said first reference axis;

wherein said engine assembly is disposed within said engine assembly receptacle of said muffler assembly, and wherein said muffler assembly does not protrude beyond an outermost perimeter of said engine assembly; and wherein said vehicle comprises a propeller that is integrated for a pull-type configuration, wherein said second exhaust outlet port is open and directs an exhaust flow parallel to a plane in which said propeller rotates, and wherein said first exhaust outlet port is plugged.

37. A muffler assembly, comprising:

a muffler body comprising first and second end portions, wherein said muffler body proceeds about a first reference axis between said first and second end portions;

a first flowpath that is within said muffler body and that also proceeds about said first reference axis;

an exhaust inlet port to said muffler body and in fluid communication with said first flowpath;

a first exhaust outlet port from said muffler body and in fluid communication with said first flowpath; and an engine assembly receptacle in the form of an open space that is disposed inwardly of said muffler body in relation to said first reference axis, wherein said muffler body further comprises:

a first chamber, wherein said exhaust inlet port leads into said first chamber;

a second chamber comprising a packing material;

a first partition between said first chamber and said second chamber, wherein said first partition comprises at least one first flow port;

a third chamber, wherein said first exhaust outlet port leads out of said third chamber; and a second partition between said second chamber and said third chamber, wherein said second partition comprises at least one second flow port;

wherein each of said first chamber, said second chamber, and said third chamber extend from said first end portion to said second end portion and proceed about said first reference axis;

wherein said second chamber is located between said first chamber and said third chamber proceeding along said first reference axis; and wherein said first partition comprises a plurality of said first flow ports, wherein said second partition comprises a plurality of said second flow ports, wherein a collective cross-sectional area of said first flow ports is less than a collective cross-sectional area of said second flow ports, and wherein a cross-sectional area is taken perpendicular to a flow through a flow port.

* * * * *